US011234881B2

(12) United States Patent
Williams

(10) Patent No.: US 11,234,881 B2
(45) Date of Patent: Feb. 1, 2022

(54) PORTABLE NEGATIVE-PRESSURE MEDICAL/DENTAL PROCEDURES AND ISOLATION CHAMBER

(71) Applicant: Jerry K. Williams, Savannah, GA (US)

(72) Inventor: Jerry K. Williams, Savannah, GA (US)

( * ) Notice: Subject to any disclaimer, the term of this patent is extended or adjusted under 35 U.S.C. 154(b) by 0 days.

(21) Appl. No.: 16/884,642

(22) Filed: May 27, 2020

(65) Prior Publication Data

US 2021/0330535 A1 Oct. 28, 2021

Related U.S. Application Data

(60) Provisional application No. 63/015,146, filed on Apr. 24, 2020.

(51) Int. Cl.
*A61G 10/02* (2006.01)
*A61G 10/00* (2006.01)

(52) U.S. Cl.
CPC ..... *A61G 10/023* (2013.01); *A61G 10/005* (2013.01); *A61G 2210/00* (2013.01)

(58) Field of Classification Search
CPC ..... A61G 10/00–04; A61M 21/0094; A61H 33/14; A61H 2033/141–148; A62B 31/00; A62B 15/00; A62B 17/00–08; A62B 18/00–10
See application file for complete search history.

(56) References Cited

U.S. PATENT DOCUMENTS 3,552,391 A * 1/1971 Deaton ..... A61G 10/04 128/205.26
3,710,791 A * 1/1973 Deaton ..... A61G 11/00 128/205.26
3,889,670 A * 6/1975 Loveland ..... A61G 10/04 128/203.12
4,949,714 A * 8/1990 Orr ..... A61G 10/04 128/200.24
6,460,538 B1 * 10/2002 Kemp ..... A62B 17/04 128/201.22
6,508,850 B1 1/2003 Kotliar
7,406,978 B2 8/2008 Mintie et al.
(Continued)

OTHER PUBLICATIONS

Mitchell, Kyle, "Kalamazoo company makes 'cube' to protect hospital staff from COVID-19", https://www.woodtv.com/health/coronavirus/kalamazoo-company-makes-cube-to-protect-hospital-staff-from-covid-19/, (Apr. 6, 2020), 24 pgs.
(Continued)

*Primary Examiner* — Thaddeus B Cox
(74) *Attorney, Agent, or Firm* — Richard Piercy; Grell & Watson Patent Attorneys LLC

(57) ABSTRACT

A portable negative air pressure apparatus for isolating a treatment subject to permit a selected treatment procedure to be performed by a treatment operator. The apparatus comprises an air source connected to a closed chamber for sealable disposition over the head, neck and upper thorax of the treatment subject with the chamber having air ports, in and out. The chamber has rigid clear sides and a plurality of sealed ports, with the ports including sealed armholes for access, and with sealed gloves connected to the sealed armholes. The chamber also has at least one instrument hatch to permit introduction into the chamber of instruments for carrying-out the selected treatment procedure.

13 Claims, 2 Drawing Sheets

(56) References Cited

U.S. PATENT DOCUMENTS

| | | | | |
|---|---|---|---|---|
| 7,479,103 | B2 | 1/2009 | Ellen | |
| 9,956,325 | B2 | 5/2018 | Malhi | |
| 10,905,839 | B1 * | 2/2021 | Bui | A61M 16/0087 |
| 2010/0044372 | A1 | 2/2010 | Kournikakis et al. | |
| 2011/0000484 | A1 | 1/2011 | Melsheimer | |
| 2011/0240017 | A1 * | 10/2011 | Butler | A61G 10/04 128/201.25 |
| 2015/0290480 | A1 * | 10/2015 | Ritchie | A61M 16/06 128/201.23 |
| 2016/0074268 | A1 * | 3/2016 | Breegi | A61G 11/009 600/21 |
| 2016/0107006 | A1 * | 4/2016 | Giulianotti | A62B 18/10 128/201.28 |
| 2017/0231848 | A1 | 8/2017 | VanBasten | |

OTHER PUBLICATIONS

Nippon Medical & Chemistry Instruments, Co., Ltd., "Portable Isolation Bed under Negative Pressure CIB-2000S", http://www.nihonika.co.jp/en/t/e_cib-2000s.htm, (2009), 1 pg., Japan.

* cited by examiner

PORTABLE NEGATIVE-PRESSURE MEDICAL/DENTAL PROCEDURES AND ISOLATION CHAMBER

CROSS-REFERENCE TO RELATED APPLICATION

This application is based upon and claims priority to U.S. Provisional Patent Application No. 63/015,146, filed on Apr. 24, 2020, and entitled "Portable Negative-Pressure Medical/Dental Procedures And Isolation Chamber". The entire content of this application is incorporated herein by reference.

BACKGROUND

Field of the Invention

The present invention is directed to apparatus and methods for performing dental and/or medical procedures on a patient wherein both the patient and the dentist or doctor are protected from cross-contamination via substantial isolation by a portable, disposable, transparent negative-pressure medical/dental procedures and isolation chamber.

Description of Related Art

Various forms of negative-pressure medical/dental procedure and isolation devices have existed in the prior art for performing various medical procedures on a patient. One example is shown in U.S. Pat. No. 6,508,850 which is directed to a Clean Air Tent System. Another such device is shown in U.S. Pat. No. 7,406,978 directed to an Environmental Containment Unit.

A further prior art example is set forth in US 2011/0000484 A1, which is directed to Vascular Therapy Using Negative Pressure; U.S. Pat. No. 9,956,325 B2 is directed a Canister for a Negative Pressure Wound Therapy Device; and, U.S. Pat. No. 7,479,103 B2 is directed to a Portable Procedures and Enclosure device.

Other prior art devices and methods include US 2010/0044372 A1, which is directed to Portable Collapsible Chem./Bio. Isolators; and, US 2017/0231848, which is directed to Medical Procedures and Transport Systems.

A Kalamazoo, Mich. company, Schupan Aluminum and Plastic Sales, has similarly disclosed an acrylic cube that is open at the base and the side facing the patient's body. See https://www.woodtv.com/health/coronavirus/kalamazoo-company-makes-cube-to-protect-hospital-staff-from-covid19/.

Whereas, yet another device is a Portable Procedures Bed for moving infected patients, wherein the collapsible isolator is maintained under negative pressure, and having an exhaust system equipped with HEPA filter treated with bactericidal enzymes. See http://www.nihonika.co.jp/en/t/e_cib-2000 s.htm However, such prior art devices and methods have had a number of defects and deficiencies, which are substantially ameliorated by the present invention.

SUMMARY OF THE INVENTION

In some preferred examples or embodiments, a portable, transparent negative-pressure medical/dental procedures isolation chamber fits over the patient's head, neck, torso or other parts of the body that allows the medical professionals to work on the patient, for example in a dental chair, while decreasing the risk of airborne transmission of transmissible diseases, such as COVID-19 and tuberculosis, but would also protect the staff and surrounding people from exposure to toxic substances, such as when dentists remove amalgam fillings that contain mercury.

The inventive chamber device hereof provides a clean air source to the interior thereof that uses commercially available air purification devices and provides an outflow device that pulls air out of the chamber and into an air filtration/purification system that, in turn, discharges clean air into the environment—all, while creating and maintaining a negative-pressure environment inside the chamber device.

The device has access holes that allow diaphragmatic entry points and sleeved entry into the interior of the chamber for performing procedures on the patient and allowing instruments and materials necessary for treating the patient.

The diaphragms and sleeves are disposable and the device can be easily sanitized between patients to allow rapid turnover of operatories while still maintaining a safer environment.

BRIEF DESCRIPTION OF THE DRAWING

Various examples are described herein in conjunction with the following figures, wherein.

DETAILED DESCRIPTION OF PREFERRED EMBODIMENTS

This invention hereof may take many different forms. The drawings and the description of the invention detail several preferred embodiments of the invention. It should be understood that the present disclosure is to be considered as but an example of the principles of the invention. The disclosure is not intended to limit the broad aspect of the invention to the embodiments illustrated.

Figure 1:
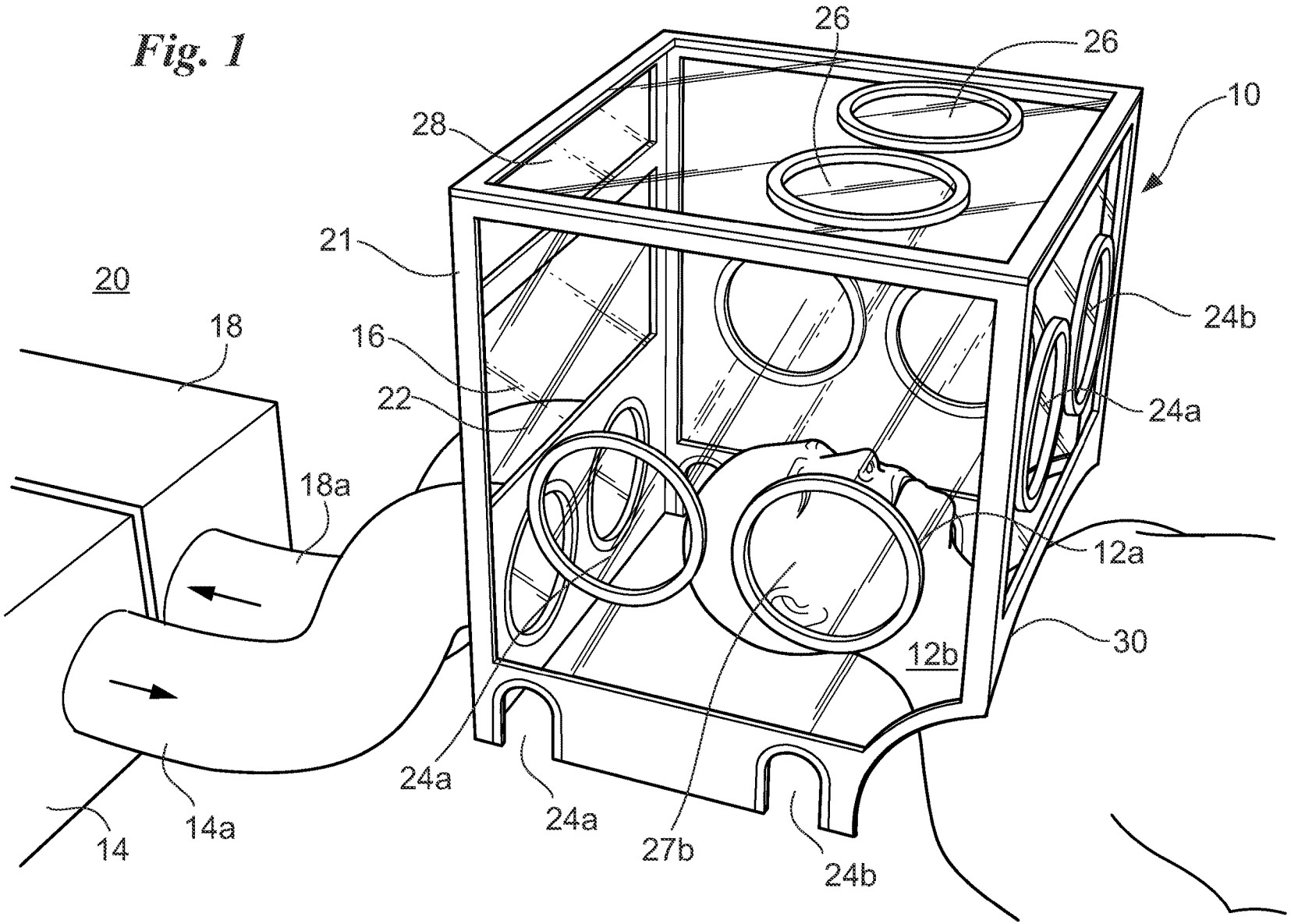
FIG. 1 is a perspective view of a preferred embodiment of the present invention, showing in this embodiment the chamber device disposed over the head and neck of the patient, with the chamber device having a frame and transparent walls, and including therein a plurality of access arches or holes (for hoses and the like), and a plurality of diaphragmatic entry points therein to provide access for the gloved hands of the dentist or surgeon, and further showing and air purification system, such as for example and with out limitation HEPA and/or UV or other suitable air filter input and output elements.

Referring now to the FIGS. 1 and 2, in one illustrated preferred example or embodiment, a portable, transparent negative-pressure medical/dental procedures and isolation chamber generally 10 (hereinafter sometimes "the chamber device 10"), that fits in this example over the patient's head and neck 12, is shown. However, the invention is not limited to any particular part of the body, inasmuch as for example a leg that is infected may benefit materially from use of the present inventive structure and methods. This structure permits the medical professionals (such as, for example, dentists, surgeons, nurses, etc.) to work on the patient's head area and/or neck areas 12*a*, 12*b*. One example would be a patient disposed within a dental chair for dental treatment.

The portable, transparent negative-pressure medical/dental procedures and isolation chamber 10 of the present invention functions (i) to materially decrease the risk of airborne transmission of transmissible diseases, such as COVID-19 and tuberculosis, but also, (ii) to protect the staff and surrounding persons from exposure to toxic substances, such as for example when dentists remove amalgam fillings that contain mercury.

The chamber device 10 would provide a clean air input source 14, such as for example a HEPA and/or UV or other suitable air filter source, connected by an input-hose 14*a* to the interior 16 thereof, and an outflow air filtration/purification system device 18, such as a HEPA and/or UV or other suitable air filter filtration and decontamination source, connected to chamber device 10 by output-hose 18*a* that pulls air out of interior 16 of chamber 10 and into an air filtration/purification system 18, that then discharges clean air into the environment 20 while creating and maintaining a negative-pressure environment in interior 16 of chamber device 10 to remove bacteria, viruses, and toxic substances therefrom.

Chamber device 10, which may be formed in this embodiment from a substantially rigid frame 21 and transparent walls 22 of polycarbonate or acrylic or other suitable transparent and sufficiently rigid substances, has a plurality of access arches or holes 24*a* and 24*b* thereinto and plurality of diaphragmatic entry points 26*a* and 26*b* and sleeved entry ports 27*a* and 27*b* in transparent walls 22, to provide access into interior 16 of chamber 10 to permit medical and/or dental procedures to be performed on the patient. Such sleeved entry ports 27*a*,27*b* may thus have gloves sealed around sleeved entry port peripheries 27*c* thereof. Transparent walls 22 may preferably further include an instrument hatch 28 for allowing entry thereinto of instruments and materials necessary for treating the patient.

The frame 21 may have disposable two-sided tape 30 disposed on the lower edge thereof to provide a modicum of a seal, in order to maintain a substantial negative pressure within chamber device 10, although such sealing function of chamber device 10 need not be air-tight due to the negative pressure therewithin. Of course, when the procedure upon a patient has been completed, such two-sided tape may be removed and discarded, whereupon the non-disposable elements of the invention comprising the chamber 10 and the in-put and out-put hoses 14*a* and 18*a* may be disinfected with suitable means known to those of ordinary skill in the relevant medical fields.

Figure 2:
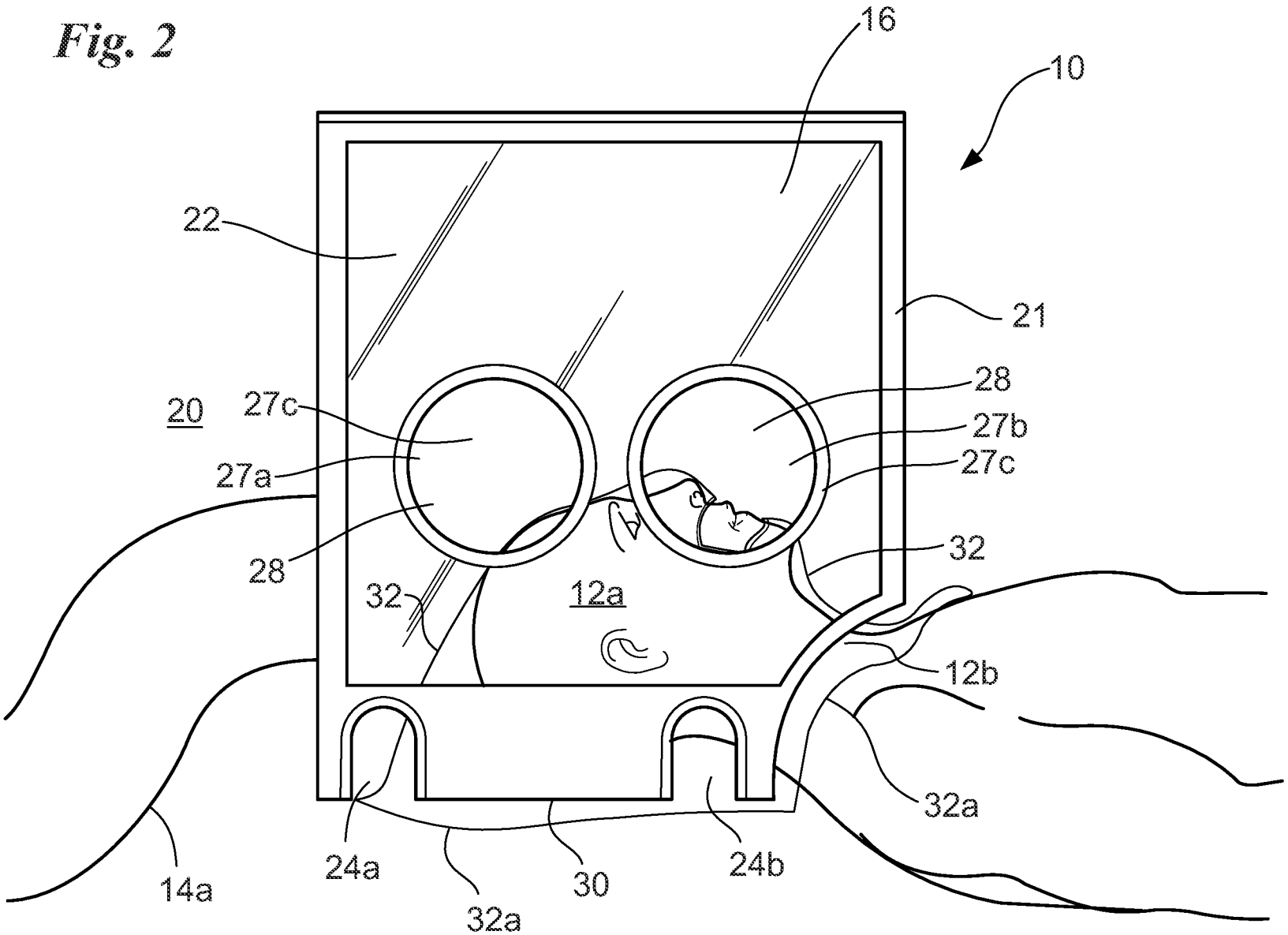
FIG. 2 is a side view of a preferred embodiment of the present invention, showing the chamber device, having transparent walls with access arches or holes, and a plurality of diaphragmatic entry points therein, and yet further showing a disposable and flexible patient covering.

Referring now to FIG. 2, in other preferred embodiments, a disposable and flexible patient covering 32 may be provided to cover substantially the entirety of the patient's head and neck areas 12*a*, 12*b*. Such patient covering 32 includes sealing means 32*a* disposed at the periphery thereof to seal-off the patients head and neck area 12*a*, 12*b*.

The diaphragms 26 and sleeves 28 are formed from suitable disposable materials, which are known in the art. Accordingly, chamber device 10 can be easily sanitized between patients to allow rapid turnover of operatories, while still maintaining a safer environment. Deposable diaphragms 26, sleeves 28, patient cover 32 and a patient wipe (not shown) may be provided in a sealed kit to facilitate efficient use of the invention hereof.

Reference in the specification to, "embodiments", "examples," "various examples," "some examples," etc. means that a particular feature, structure, or characteristic described in connection with the examples is included in at least one example of the invention. The appearances of the above-referenced phrases in various places in the specification are not necessarily all referring to the same example. Reference to examples is intended to disclose examples, rather than limit the claimed invention. While the invention has been particularly shown and described with reference to several examples, it will be understood by persons skilled in the relevant art that various changes in form and details can be made therein without departing from the spirit and scope of the invention.

It should be noted that the language used in the specification has been principally selected for readability and instructional purposes, and may not have been selected to delineate or circumscribe the inventive subject matter. Accordingly, the present disclosure is intended to be illustrative, but not limiting of the scope of the invention.

It is to be understood that the figures and descriptions of example embodiments of the present disclosure have been simplified to illustrate elements that are relevant for a clear understanding of the present disclosure, while eliminating, for purposes of clarity, other elements, such as, for example, details of system architecture, Those of ordinary skill in the art will recognize that these and other elements may be desirable for practice of various aspects of the present examples. However, because such elements are well known in the art, and because they do not facilitate a better understanding of the present disclosure, a discussion of such elements is not necessary to be provided herein.

It can be appreciated that, in some examples of the present methods and systems disclosed herein, a single component can be replaced by multiple components, and multiple components replaced by a single component.

Except where such substitution would not be operative to practice the present methods and systems, such substitution is within the scope of the present disclosure. Examples presented herein, including operational examples, are intended to illustrate potential implementations of the present method and system examples. It can be appreciated that such examples are intended primarily for purposes of illustration. No particular aspect or aspects of the example method, product, and/or system examples described herein are intended to limit the scope of the present disclosure.

These descriptions and representations are the means used by those skilled in the art to most effectively convey the substance of their work to others skilled in the art. A method is here, and generally; conceived to be a sequence of actions (instructions) leading to a desired result. The actions are those requiring physical manipulations of physical quantities. The present dis closure also relates to an apparatus for performing the operations herein.

Specific embodiments have been illustrated and described. Numerous modifications come to mind without significantly departing from the spirit of the invention. The scope of protection is only limited by the scope of the subsequent claims.

What is claimed is:

1. A portable negative air pressure apparatus for isolating a treatment subject to permit a selected treatment procedure to be performed by a treatment operator thereon, said apparatus comprising:

an air source having an air source in and an air source out;

a closed chamber connected to said air source, said chamber having a port connected to said air source in and a second air source port connected to said air source out, said chamber is formed from a rigid clear polymeric material;

said chamber adapted for sealable disposition over the head, neck and upper thorax of the treatment subject, and said chamber having a plurality of sealed ports;

said ports including sealed armholes for access thereinto, and with sealed gloves connected to said sealed armholes; and said chamber further including at least one instrument hatch to permit introduction into the chamber of instruments for carrying out the selected treatment procedure.

2. The portable negative air pressure apparatus of claim 1 wherein said polymeric material is polycarbonate.

3. The portable negative air pressure apparatus of claim 1 wherein said polymeric material comprises acrylic polymers.

4. The portable negative air pressure apparatus of claim 1 wherein said chamber comprises a rigid front wall, back wall, two side walls and a top wall joined together at the edges thereof.

5. The portable negative air pressure apparatus of claim 4 wherein said rigid front wall, two side walls and said top wall have one or more sealed armholes for gloved access into said chamber.

6. The portable negative air pressure apparatus of claim 4 wherein each of said rigid front wall, two side walls and said top wall have two sealed armholes for gloved access into said chamber.

7. The portable negative air pressure apparatus of claim 4 wherein said rigid side walls have at least one hose port disposed therein for access of a treatment hose into said chamber.

8. The portable negative air pressure apparatus of claim 4 wherein said rigid side walls have a curved contoured surface at a proximal portion thereof for mateable engagement with a shoulder of the treatment subject.

9. The portable negative air pressure apparatus of claim 4 wherein said rigid front wall has a lower surface for mateable engagement with an upper portion of the chest of the treatment subject.

10. The portable negative air pressure apparatus of claim 1 further comprising a disposable polymeric covering for the head, neck and upper thorax of the treatment subject when undergoing the selected treatment procedure.

11. The portable negative air pressure apparatus of claim 10, wherein said disposable polymeric covering includes at least one access opening thereinto to permit access only to the portion of the treatment subject undergoing the selected treatment procedure.

12. The portable negative air pressure apparatus of claim 10, wherein said disposable polymeric covering includes margins sealable under the rigid front wall and side walls of said chamber.

13. The portable negative air pressure apparatus of claim 1 wherein the air source is a High Efficiency Particulate Air (HEPA) source.

* * * * *